US006450363B1

(12) United States Patent
Lin

(10) Patent No.: US 6,450,363 B1
(45) Date of Patent: Sep. 17, 2002

(54) COFFEE MUG WITH INTERCHANGEABLE ACCESSORIES

(76) Inventor: Shin-Shuoh Lin, 27022 Falling Leaf Dr., Laguna Hills, CA (US) 92653

( * ) Notice: Subject to any disclaimer, the term of this patent is extended or adjusted under 35 U.S.C. 154(b) by 91 days.

(21) Appl. No.: 09/764,229

(22) Filed: Jan. 19, 2001

(51) Int. Cl.[7] ..... B65D 25/28

(52) U.S. Cl. ..... 220/758; 16/425; 220/212.5; 220/710.5; 220/759

(58) Field of Search ..... 220/752, 753, 220/758, 759, 775, 710.5, 212.5, 630; 16/425

(56) References Cited

U.S. PATENT DOCUMENTS

| | | | | |
|---|---|---|---|---|
| 1,550,618 A | * | 8/1925 | Kemp | 220/710.5 |
| 3,252,728 A | * | 5/1966 | Holton | 16/422 |
| 4,040,549 A | * | 8/1977 | Sadler | 215/376 |
| 4,754,888 A | | 7/1988 | Letch et al. | |
| 5,249,703 A | | 10/1993 | Karp | |
| 5,294,018 A | * | 3/1994 | Boucher | 215/376 |
| D346,933 S | | 5/1994 | Denny et al. | |
| D362,156 S | | 9/1995 | Goto et al. | |
| D362,369 S | | 9/1995 | Bridges | |
| D372,838 S | | 8/1996 | Feltman et al. | |
| D373,051 S | | 8/1996 | Kramer et al. | |
| D386,948 S | | 12/1997 | Wissinger | |
| D396,777 S | | 8/1998 | Inoue | |
| D398,187 S | | 9/1998 | Parker | |
| D411,713 S | | 6/1999 | Bridges | |
| 5,918,761 A | | 7/1999 | Wissinger | |
| D416,757 S | | 11/1999 | Ginuntoli | |
| D417,819 S | | 12/1999 | Kelly-Pollet | |
| D425,758 S | | 5/2000 | Freed | |

* cited by examiner

*Primary Examiner*—Lee Young
*Assistant Examiner*—Joseph C. Merek
(74) *Attorney, Agent, or Firm*—Gordon K. Anderson

(57) ABSTRACT

A coffee mug (60) with interchangeable accessories that include a coffee mug body (62) with a groove (70) around the upper outside surface and a lid (76) removably inserted into the body. A replaceable handle bracket (84) is attached to the groove in the body and a detachable handle (100) is connected to the bracket and held in place with a clip (102). A removable docking station (116) is rotatably attached to a base (72) on the bottom of the coffee mug The accessory lid, bracket, handle and docking station are individually selected to personalize the appearance and tactile qualities of the coffee mug.

13 Claims, 8 Drawing Sheets

84
98
7
86
96
7
86

84
98
10
96
10
88

11
84
98
96
11
90
88
90

86
15
96
15
92
98
84
94

94
96
86

96
86

96
86
98

COFFEE MUG WITH INTERCHANGEABLE ACCESSORIES

TECHNICAL FIELD

The present invention relates to coffee mugs in general. More specifically to a mug with interchangeable accessories for personalizing its appearance and tactile qualities.

BACKGROUND ART

Previously, many styles and types of coffee mugs have been developed in endeavoring to achieve a pleasing appearance and handling qualities. Prior art has attempted to accomplish this quality by making a large number of individual mugs each having different characteristics however none have made these features interchangeable.

A search of the prior art did not disclose any patents that possess any of the novelty of the instant invention, however the following U.S. patents are considered related:

| U.S. Pat. No. | Inventor | Issue Date |
|---|---|---|
| Des. 346,933 | Denny et al. | May 17, 1994 |
| Des. 362,156 | Goto et al. | Sep 12, 1995 |
| Des. 362,369 | Bridges | Sep 19, 1995 |
| Des. 372,838 | Feltman et al. | Aug 20, 1996 |
| Des. 373,051 | Kramer et al. | Aug 27, 1996 |
| Des. 386,948 | Wissinger | Dec 02, 1997 |
| Des. 396,777 | Inoue | Aug 11, 1998 |
| Des. 398,187 | Parker | Sep 15, 1998 |
| Des. 411,713 | Bridges | Jun 29, 1999 |
| Des. 416,757 | Ginuntoli | Nov 23, 1999 |
| Des. 425,758 | Kelly-Pollet | Dec 21, 1999 |
| Des. 425,758 | Freed | May 30, 2000 |
| 4,754,888 | Letsch et al. | Jul 05, 1988 |
| 5,249,703 | Karp | Sep 05, 1993 |
| 5,918,761 | Wissinger | Jul 06, 1999 |

Letsch et al. in U.S. Pat. No. 4,754,888 discloses a carafe with an inner container surrounded by a casing. The inner container and the casing have an opening at the top which may be closed by a separate plug. The plug and opening in the container and casing are shaped such that it is possible to fill or empty the inner container while the plug is still in the opening. The plug and container both have mating grooves that provide opposed flow paths into and out of the container. The container also includes a basin around the top for receiving coffee from a coffee maker and the plug has openings to provide a flow path from the basin into the container interior.

Karp in U.S. Pat. No. 5,249,703 teaches a travel mug that includes a container and a lid in combination. The container has a handle and an annular lip that has an annulus capable of forming a seal with the top side of the annular lip. A cylindrical well in the lid has a vertical dividing wall such that the lid may be readily rotated by hand. The retaining arms extend from the underside of the lid and engage the underside of the annular lip to pull it into tight abutment. Diametrically opposed gaps in the lip act as passageway for the retaining arms. Similarly diametrically opposed notches in the lid align with the gaps to allow liquid to be poured from the container.

U.S. Pat. No. 5,918,761 issued to Wissinger is for an insulated container and cover combination that has an outer container shell terminating at an opening with a surrounding edge. An inner container shell is nested within the outer container shell and has an opening surrounded by a continuous edges in abutment with the surrounding edge. The inner container shell is spaced inwardly and is out of contact with the outer shell. A cover mounting assembly is attached to the outer shell adjacent to the opening. A single seal, made of elastomeric material, has a sealing surface disposed at the interface of the shells. Locating rings define the removable cover mounting assembly and locate the single sealing ring on the inner and outer shells.

For background purposes and as indicative of the art to which the invention is related reference may be made to the remaining cited design patents.

DISCLOSURE OF THE INVENTION

Coffee mugs are frequently used by many people and they are carried from place to place throughout the entire day becoming a rather personal item. Fairly recently stainless steel vacuum insulated or double wall coffee mugs have been introduced that have a very attractive appearance and they are popular in this country as well as throughout the world. Since these mugs have an advantage in there insulating qualities and are shaped pleasing to the eye, they can become a source of pride to the user. In an attempt to fill the needs of the public, many different shapes and styles of mugs have been developed and marketed. The problem of taste still remains, however, since what is attractive to one person may not look good to another.

Therefore a primary object of the invention is to have a mug with interchangeable accessories permitting the indivedual to select the combination of components that appears to be the best in their personal judgment. By marketing the accessory components separately individuals may not only select the combination that is pleasing in appearance to their taste but may choose a handle that has a good feel and is easy for the person to grip, therefore both the attractiveness and comfort may be simultaneously satisfied.

Another object of the invention is that the lid, handle and docking station may all be selected individually. The lid may have different color, surface finish and features such as a simple opening for pouring, a stopper for positive leak tight sealing or a convenient sliding cover. The handle includes a replaceable bracket that fits into a groove in the mug body which may have a number of shapes and colors with the handle itself varying in shape and size. The handle is attached to the bracket with a clip that blends into the shape of the handle and yet is removable per se. To assure a constant tight fit between the bracket and the mug body optionally a bracket may be selected, containing a number of radial grooves that are spaced around its periphery. The radial grooves retain small o-rings that compress and hold the bracket securely in place in applications where its use requires structural integrity.

An important object of the invention is directed to the ability of the mug to have a docking station attached to the bottom. The removable docking station has threads in the center to mate with mating threads in the coffee mug base. This permits the best of both worlds in that when the coffee mug is used on a flat surface the station permits it to be very stable since the base is large enough to spread the weight evenly over a liberal area and yet when the docking station is removed it fits easily into vehicle cup holders. The stability is extremely important as it is common to place a coffee mug in close proximity to keyboards, papers and work surfaces where coffee spills could be catastrophic. Further the configuration of mug is specifically sized to fit almost all conventional cup holders in a wide number of motor vehicles.

Still another object of the invention is that a retailer may stock a wide variety of accessories and replace only the well accepted components as required, not leaving the unpopular items overstocked as is the case with the complete individual mugs. Furthermore replacement of components may be easily made at a later date, if the user decides to update the mug or if breakage occurs.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
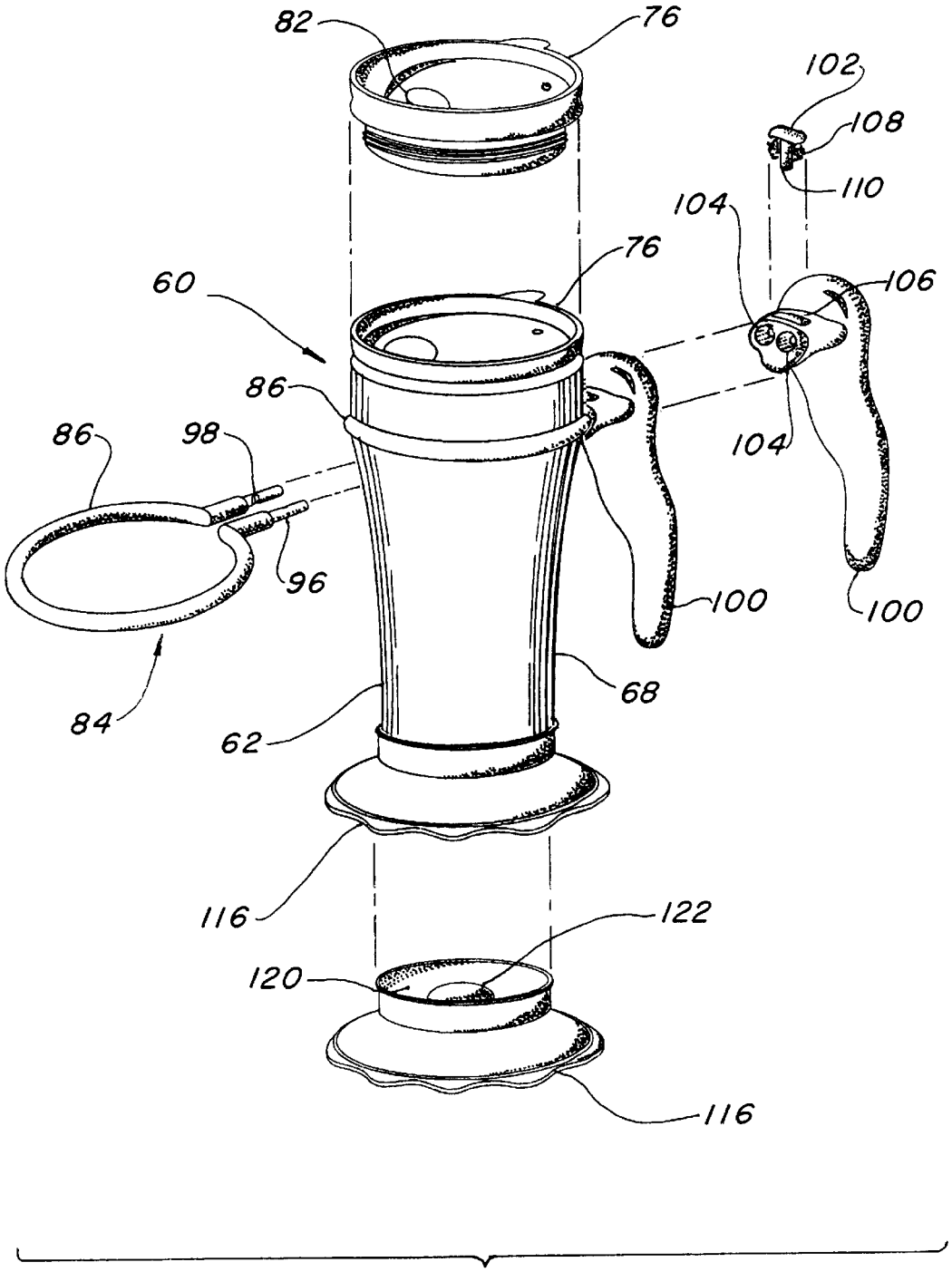
FIG. 1 is an exploded isometric view of the preferred embodiment with exemplary accessories illustrated.
Figure 2:
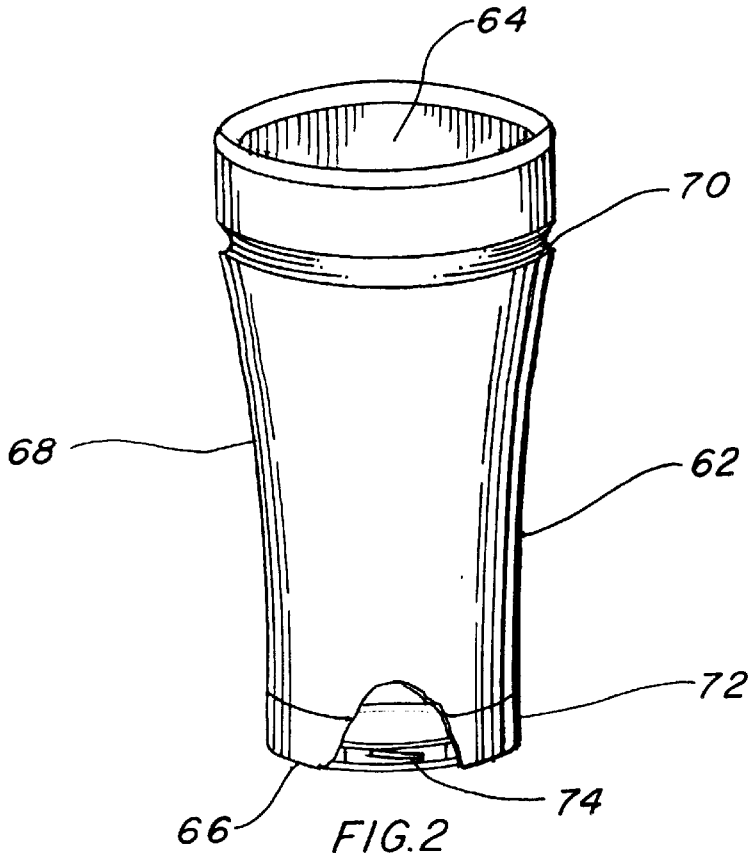
FIG. 2 is a partial isometric view of the coffee mug less accessories, completely removed from the invention for clarity.

The best mode for carrying out the invention is presented in terms of a preferred embodiment. This preferred embodiment is shown in FIGS. 1 thorough 53 and is comprised of a basic coffee mug 60 having a body 62 which has an open top 64, a bottom 66 and sides 68 with a circumferential groove 70 around an upper outside surface of the sides 68. A base 72 is attached to the bottom 66 and includes integral female threads 74 on its underside as illustrated in FIG. 2. The sides 68 are preferably constructed using stainless steel dual walls, having either a dead air space or negative pressure therebetween for thermal barrier insulation, and the bottom 66 is insulated by the base 72 which is thermoplastic in its construction.

Figure 3:
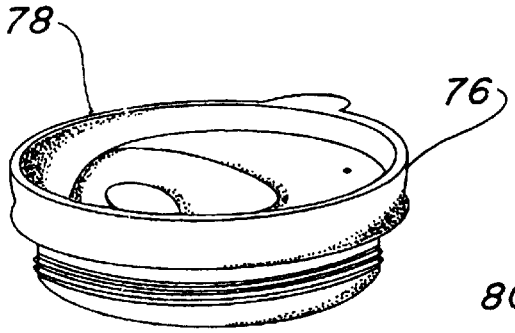
FIG. 3 is a partial isometric view of a removable lid in the sliding cover configuration, completely removed from the invention for clarity.
Figure 4:
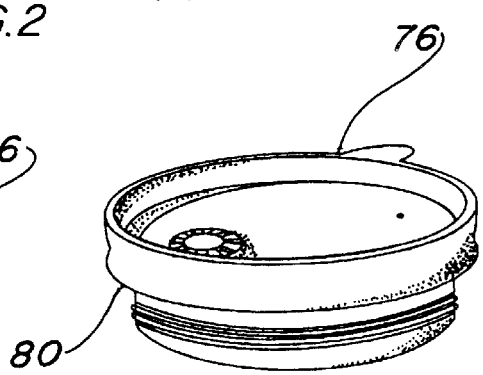
FIG. 4 is a partial isometric view of a removable lid in the opening stopper configuration, completely removed from the invention for clarity.
Figure 5:
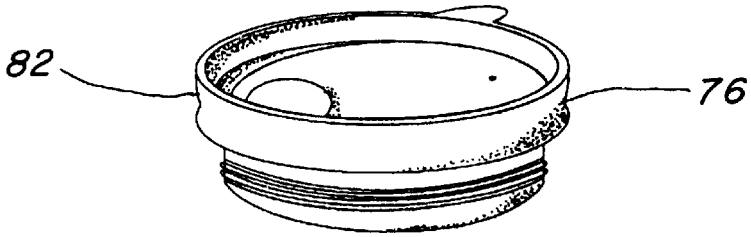
FIG. 5 is a partial isometric view of a removable lid in the basic opening configuration, completely removed from the invention for clarity.

The accessories for the coffee mug body 62 include a removable lid 76 disposed onto the mug body open top 64 as illustrated in FIG. 1. The lid 76 may be in a number of different configurations as optionally shown in FIGS. 3 to 5 in which FIG. 3 illustrates a partial isometric view of the removable lid 76 in the sliding cover configuration 78 for protecting liquids contained within the mug. FIG. 4 depicts the removable lid in the stopper configuration 80 and FIG. 5 shows the lid in the basic opening configuration 82. While only three configurations are illustrated it is not to be construed as limiting as a myriad of other styles and shapes may also be used for the lid 76.

Figures 6, 7, 8, 9, 10, 11, 12, 13, 14, 15:
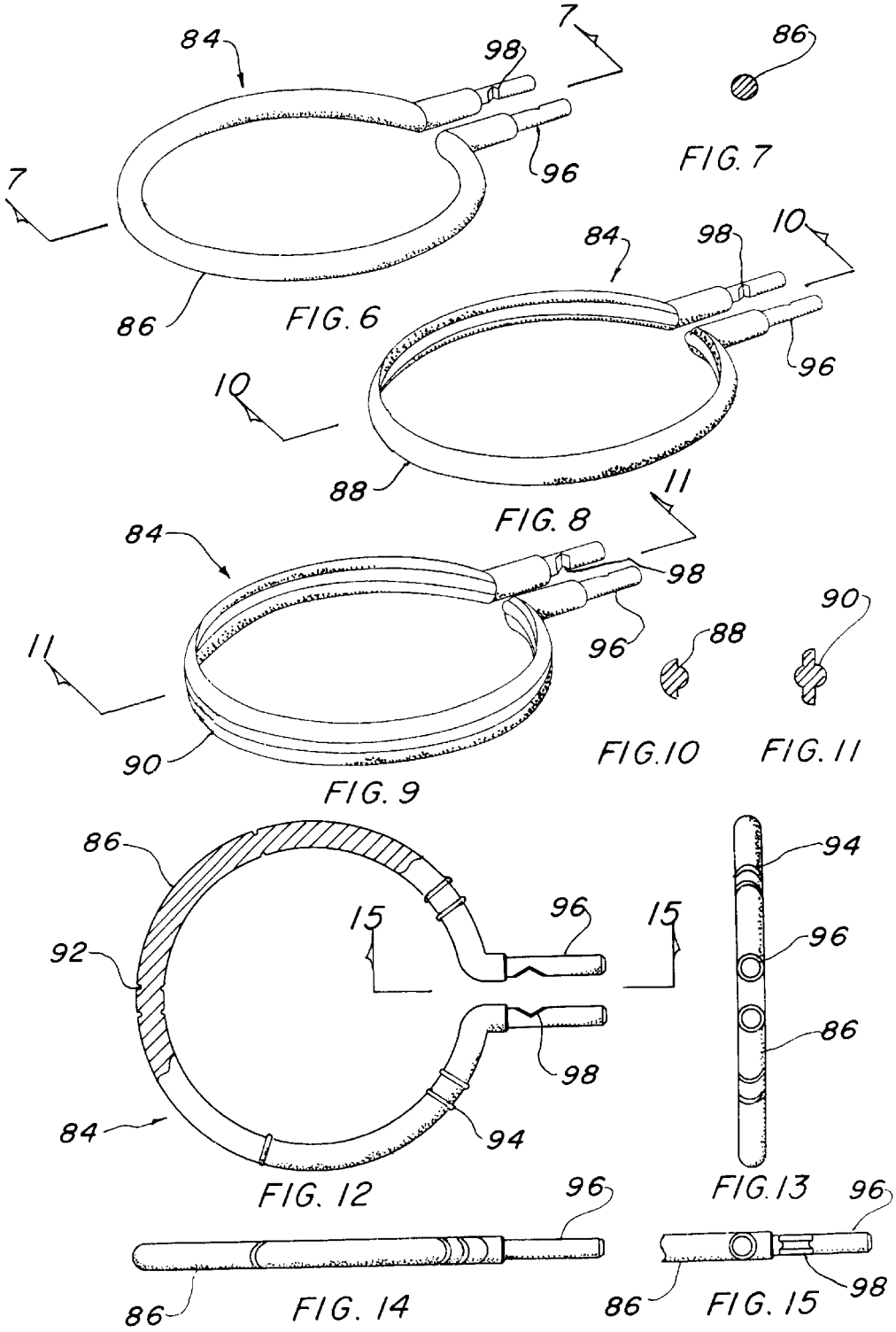
FIG. 6 is a partial isometric view of a replaceable handle bracket in the round configuration.
FIG. 7 is a cross sectional view taken along lines 7—7 of FIG. 6.
FIG. 8 is a partial isometric view of a replaceable handle bracket in the oval. configuration having a bead on the inside surface.
FIG. 9 is a partial isometric view of a replaceable handle bracket having a rectangular configuration with radiused edges and a bead on both the inside and outside surface.
FIG. 10 is a cross sectional view taken along lines 10—10 of FIG. 8.
FIG. 11 is a cross sectional view taken along lines 11—11 of FIG. 9.
FIG. 12 is a partially cut away plan view of a round shank replaceable handle bracket having radial grooves therein and o-rings positioned in the grooves.
FIG. 13 is a rear view, rotated horizontally, of a round shank replaceable handle bracket having grooves therein.
FIG. 14 is a right side view of a round shank replaceable handle bracket having grooves therein.
FIG. 15 is a cross sectional view taken along lines 15—15 of FIG. 12.
Figure 16:
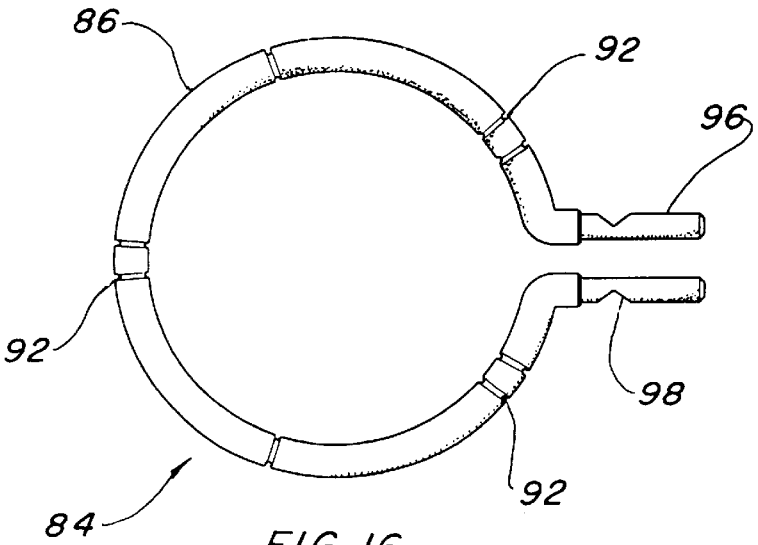
FIG. 16 is a plan view of a square shank replaceable handle bracket having radial grooves therein.
Figure 17:
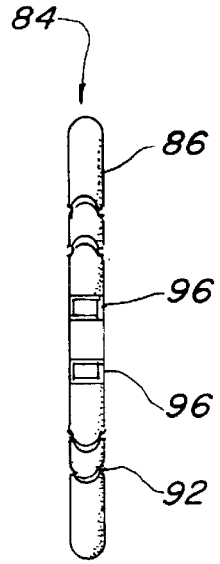
FIG. 17 is a rear view of a square shank replaceable handle bracket having grooves therein.
Figure 18:
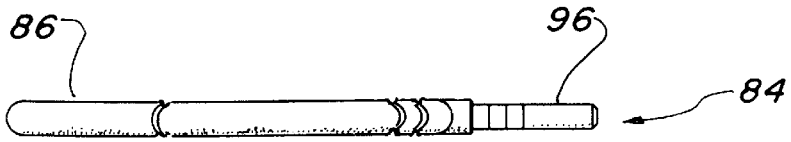
FIG. 18 is a right side view of a square shank replaceable handle bracket having grooves therein.
Figure 19:
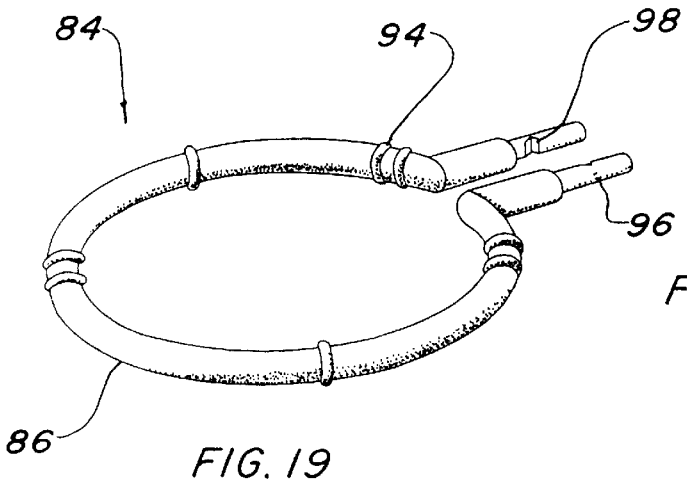
FIG. 19 is a partial isometric view of a round shank replaceable handle bracket having o-rings disposed within the grooves.
Figure 20:
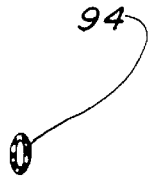
FIG. 20 is a partial isometric view of an o-ring completely removed from the invention for clarity.

The next optional accessory is a replaceable handle bracket 84 configured to interface with the groove 70 in the mug body sides 68, as shown attached in FIG. 1. Again three basic configurations are presented with FIGS. 6 and 7 illustrating a round ring structure 86 to mate in a inversely proportional manner with the groove 70 in the mug sides. FIGS. 8 and 10 depict an oval ring structure 88 having a bead on inside surface with FIGS. 9 and 11 showing a rectangular structure 90 with radiused edges and a bead on both the inside and the outside surface, again the similar bead on the inside surface mates with the groove 70 in the mug sides. A variation of the round ring structure 86 is shown in FIGS. 12 to 19 which has radial grooves 92 spaced at a predetermined distance apart around the bracket circumference with an o-ring 94 disposed within each groove 92 for maintaining a close and tight fit between the bracket 84 and the mug body 62. In any event the handle bracket 84 includes a pair of parallel protruding ends 96 with each end having a notch 98 therein for interfacing with a handle. The notch 98 may be on the inside surface as shown in FIGS. 12 to 15 or the outside surface as illustrated in FIGS. 16 to 18. While the preferred embodiment of the ends 96 are round as depicted in FIGS. 6 through 15 and 19 they may also be square as shown in FIGS. 16 to 18 either functioning in a similar manner.

Figure 21:
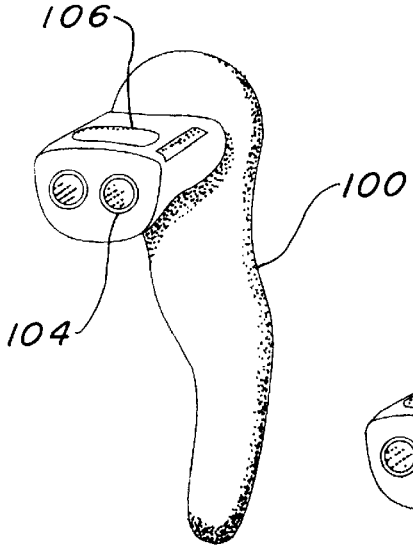
FIG. 21 is a partial isometric view of a specific shape of the detachable handle with a tapered end.
Figure 22:
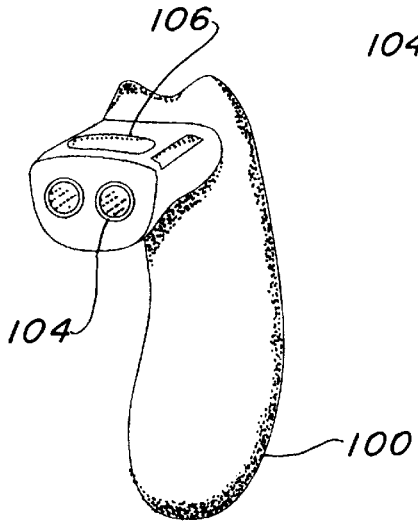
FIG. 22 is a partial isometric view of a specific shape of the detachable handle with a rounded end.
Figure 23:
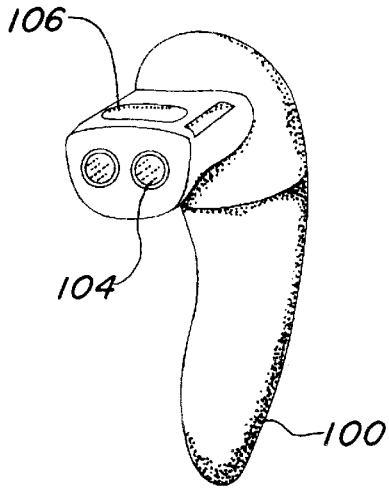
FIG. 23 is a partial isometric view of a specific shape of the detachable handle with a tapered shank end.
Figure 24:
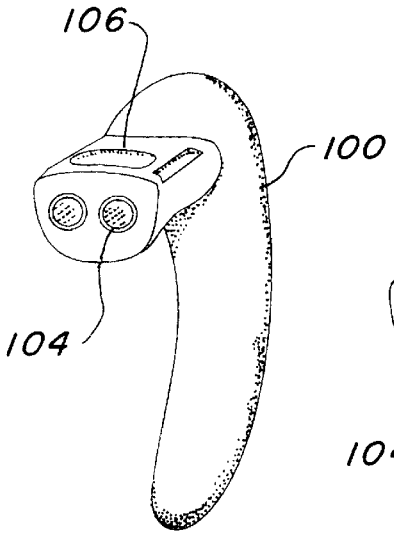
FIG. 24 is a partial isometric view of a specific shape of the detachable handle with a curved contour.
Figure 25:
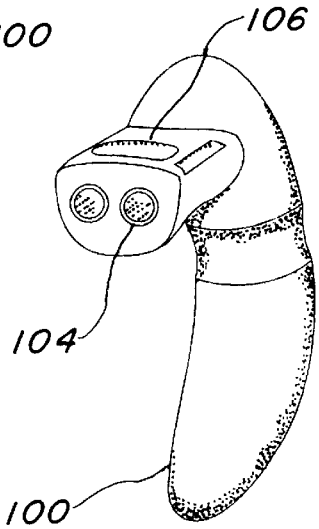
FIG. 25 is a partial isometric view of a specific shape of the detachable handle with a recessed upper section.
Figure 26:
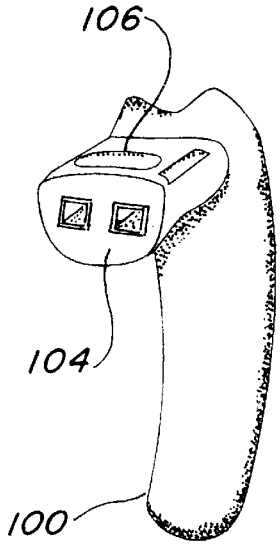
FIG. 26 is a partial isometric view of a specific shape of the detachable handle with a gradual curved outline.
Figure 27:
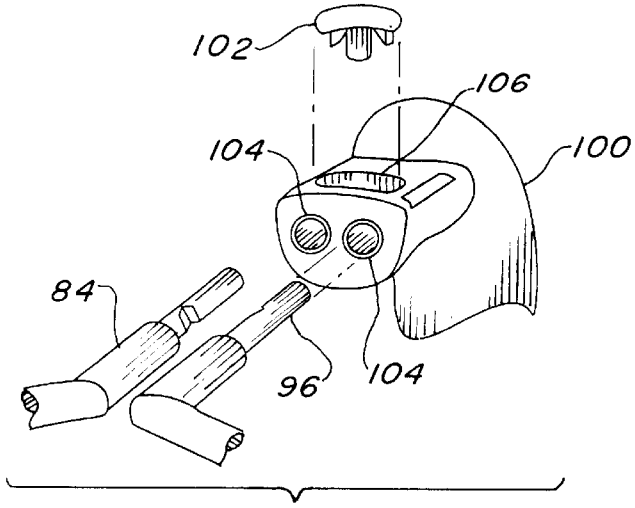
FIG. 27 is an exploded view of the detachable handle, replaceable handle bracket and inset retaining clip and their relationship.
Figure 28:
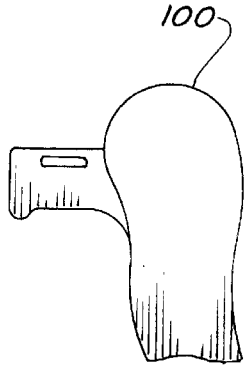
FIG. 28 is a partial right side elevational view of a representative shape of the detachable handle using the inset retaining clip.
Figure 29:
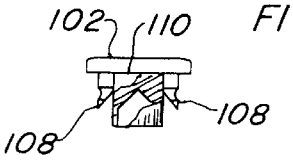
FIG. 29 is a front elevational view of a inset retaining clip.
Figure 30:
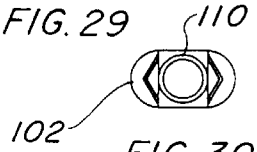
FIG. 30 is a bottom plan view of a inset retaining clip.
Figure 31:
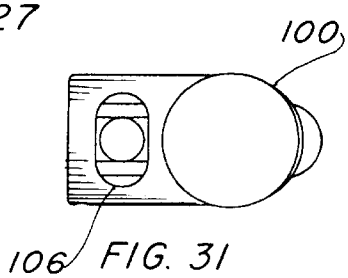
FIG. 31 is a top view of a representative shape of the detachable handle using the inset retaining clip.
Figure 32:
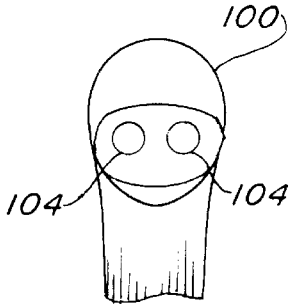
FIG. 32 is a partial front view of a representative shape of a detachable handle using the inset retaining clip.
Figure 33:
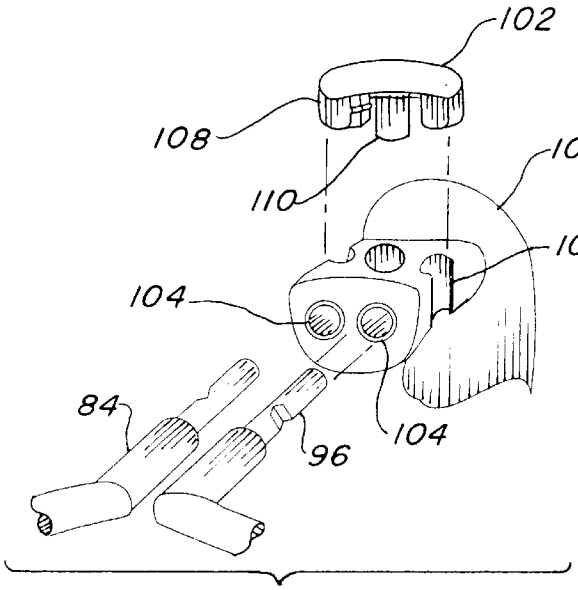
FIG. 33 is an exploded view of the detachable handle, replaceable handle bracket and v-grooved retaining clip and their relationship.
Figure 34:
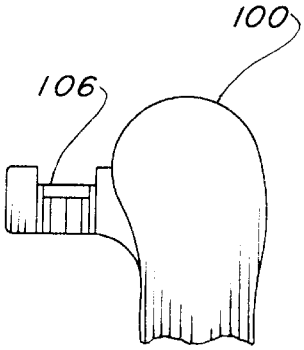
FIG. 34 is a partial right side elevational view of a representative shape of the detachable handle using the v-grooved retaining clip.
Figure 35:
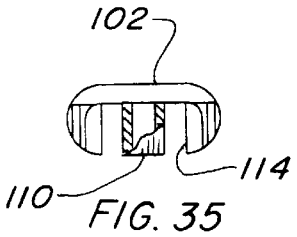
FIG. 35 is a front elevational view of a v-grooved retaining clip.
Figure 36:
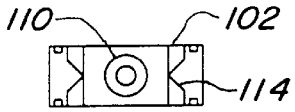
FIG. 36 is a bottom plan view of a v-grooved retaining clip.
Figure 37:
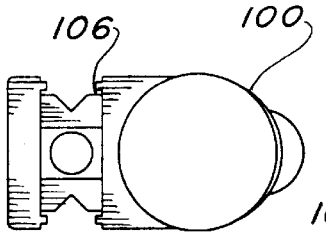
FIG. 37 is a top view of a representative shape of a detachable handle using the v-grooved retaining clip.
Figure 38:
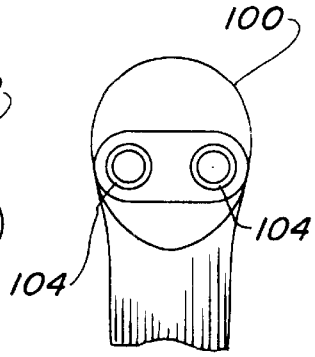
FIG. 38 is a partial front view of a representative shape of a detachable handle using the v-grooved retaining clip.
Figure 39:
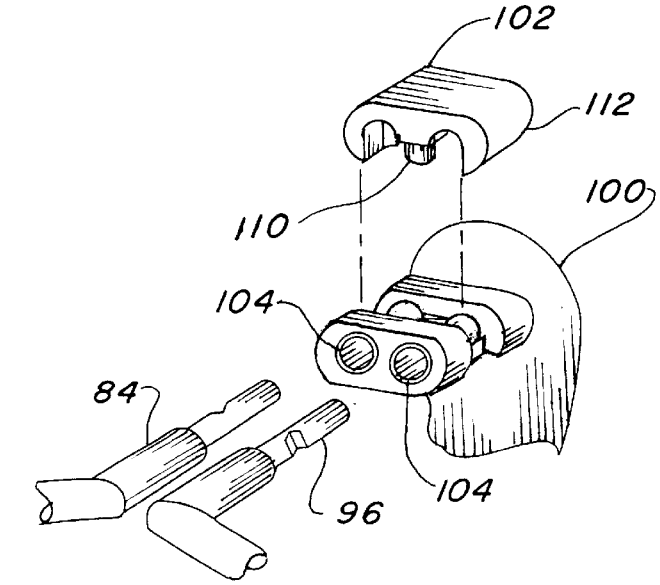
FIG. 39 is an exploded view of a detachable handle, replaceable handle bracket and encompassing retaining clip and their relationship.
Figure 40:
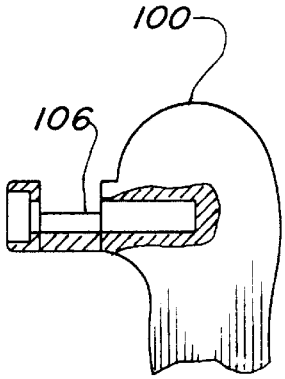
FIG. 40 is a partial right side elevational view of a representative shape of the detachable handle using the encompassing retaining clip.
Figure 41:
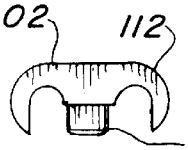
FIG. 41 is a front elevational view of a encompassing retaining clip.
Figure 42:
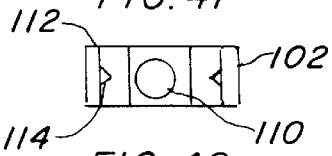
FIG. 42 is a bottom plan view of an encompassing retaining clip.
Figure 43:
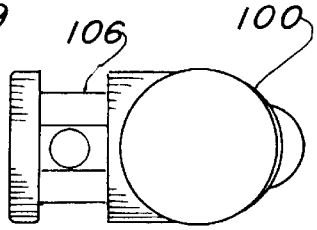
FIG. 43 is a top view of a representative shape of the detachable handle using the encompassing retaining clip.
Figure 44:
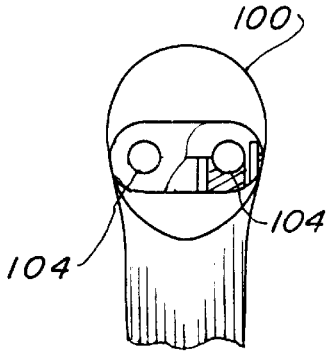
FIG. 44 is a partial front view of a representative shape of the detachable handle using the encompassing retaining clip.

A detachable handle 100, with a retaining clip 102, is connected onto the handle bracket 84 and held in place securely with the clip 102. There are two holes 104 within the upper portion of the handle 100 for receiving the parallel protruding ends 96 of the handle bracket 84 either round or square according the shape of the ends 96. When assembling the handle 100 to the bracket 84 the ends 96 are compressed together and the handle is slipped over these extending ends such that the bracket 84 is held tightly against the mug body 62 and retained within the groove 70. There are an infinite number of configurations of handle shapes that could be used however only a few are indicated in the drawings. As an example FIG. 21 is a partial isometric view of the detachable handle 100 with a tapered end. FIG. 22 illustrates the detachable handle 100 with a rounded end and FIG. 23 a tapered shank. FIG. 24 shows a curved contour while FIG. 25 has a recessed upper section. Finally FIG. 26 depicts the detachable handle 100 with a gradual curved outline further this embodiment illustrates square holes 104 to mate with the optional square parallel protruding ends 96 shown in FIGS. 16 to 18.

The handle 100 includes at least one cavity 106 for receiving and positioning the retaining clip 102 which is in three separate embodiments illustrated in FIGS. 27 through 44. The preferred embodiment is shown in FIGS. 27 through 32 and illustrates a retaining clip 102 that has a pair of integral snap-in barbs 108 configured to interface with the cavity 106 within the detachable handle 100. It may be visualized that the clip 102 is slightly smaller than the cavity 104 and that the cavity has mating indentations that receive the snap-in barbs 108 holding the clip 102 in place and a downward projecting inverted post 110 that interfaces with the notches 98 on the ends 96 of the handle bracket 84. FIGS. 33 through 38 and illustrates the second embodiment a retaining clip 102 that also has a pair of integral snap-in barbs 108 however it is configured to encompass the entire top and sides of the handle cavity 106. This so called encompassing clip 112 includes an inverted post 110 that is positioned between the protruding ends 96 and the clip 112 has a pair of v-shaped projections 114 that slip into the notches 98 on the ends 96 of the handle bracket 84 as the notches are located on the outside surface of the ends 96 and are in an inverted v-shape. FIGS. 39 through 44 and illustrates the third embodiment of the clip 102 which also encompasses the handle 100 except the notches 98 are wide enough to receive the ends of the clip 102 and a inverted post 110 penetrates the handle as above. It should be noted that only one embodiment will be used in marketing the interchangeable accessories according to the invention.

Figure 45:
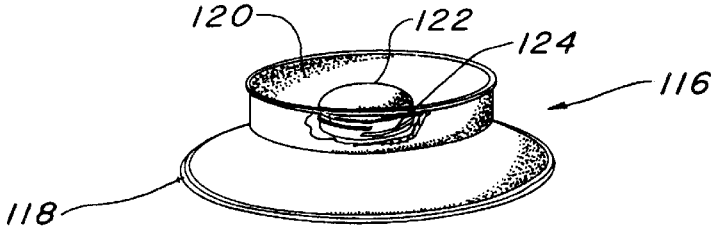
FIG. 45 is a partial isometric view of an unadorned shape of the removable docking station in the ornamental design configuration.
Figure 46:
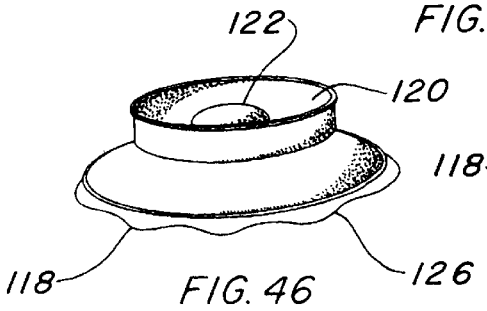
FIG. 46 is a partial isometric view of a scalloped shape of the removable docking station in the ornamental design configuration.
Figure 47:
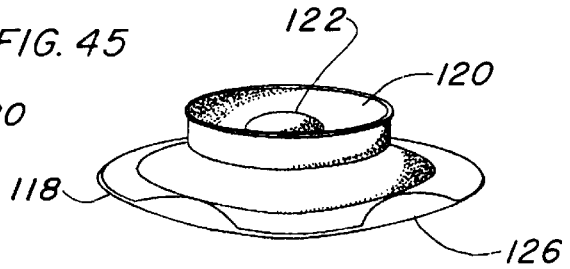
FIG. 47 is a partial isometric view of a radial cut-out shape of the removable docking station in the ornamental design configuration.
Figure 48:
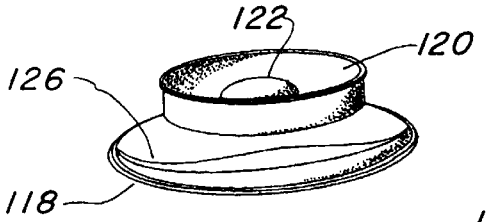
FIG. 48 is a partial isometric view of a lip shape of the removable docking station in the ornamental design configuration.
Figure 49:
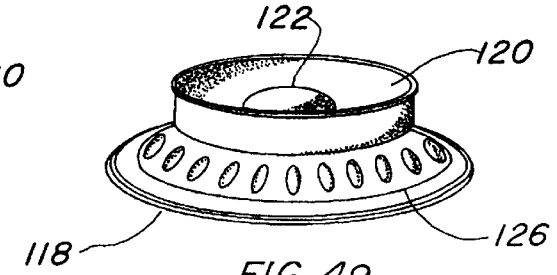
FIG. 49 is a partial isometric view of a dimpled shape of the removable docking station in the ornamental design configuration.
Figure 50:
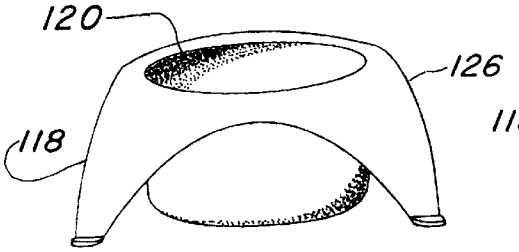
FIG. 50 is a partial isometric view of a arched shape of the removable docking station in the ornamental design configuration cut away to illustrate a resilient pad attached to the bottom.
Figure 51:
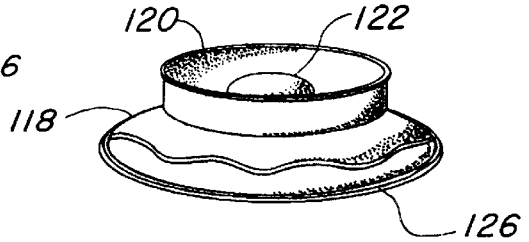
FIG. 51 is a partial isometric view of a wavy shape of the removable docking station in the ornamental design configuration.
Figure 52:
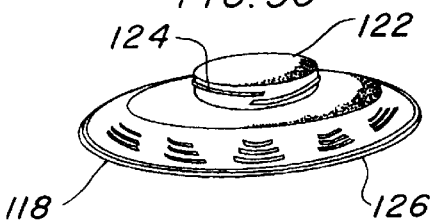
FIG. 52 is a partial isometric view of a indented shape of the removable docking station in the ornamental design configuration.
Figure 53:
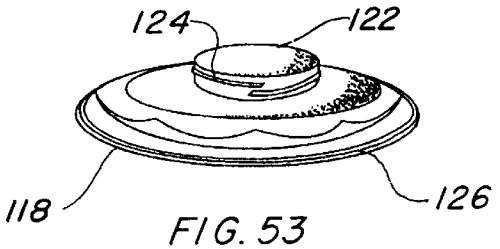
FIG. 53 is a partial isometric view of a rippled shape of the removable docking station in the ornamental design configuration.

The final element of the interchangeable accessories is a removable docking station 116 that is rotatably fastened to the base 72 of the coffee mug 60 as illustrated in FIG. 1. The docking station consists of a main docking station member 118 including, a top and a bottom, with the bottom larger in surface area than the coffee mug base 72. A recess 120 is formed in the top and includes an elevated peripheral lip sized to fit over and enclose the coffee mug base 72. A raised pedestal 122 is formed within the recess 120 of the docking station member 118, and a number of partial male threads 124 depend outwardly from the body raised pedestal 122, such that when the docking station member 118 is mated with the coffee mug base 72 and rotated, the male threads 124 interface with the base's female threads 74 bringing the pedestal 122 into intimate contact with the base 72, thus fastening the docking station 116 to the base 72 of the coffee mug 60 in a removable manner. The docking station 116 may have an optional ornamental design configuration as shown in FIGS. 45 through 53 in various colors and textures. FIG. 45 illustrates in a partial isometric view an unadorned shape of the removable docking station 116. FIG. 46 shows a scalloped shape of the ornamental design with FIG. 47 illustrating a radial cut-out shape, further FIG. 48 has a lip shape and FIG. 49 a dimpled shape. FIG. 50 depicts an arched shape ornamental design. A resilient pad (not shown) that may optionally be attached to the bottom of any of the stations 1 16 for increasing the stability of the coffee mug 60 on a flat surface, such as a table or counter top and also to create a non-slip substructure. FIG. 51 depicts a wavy shape, with FIG. 52 an indented shape and finally FIG. 53 is a partial isometric view of a rippled shape of the removable docking station 116 in the ornamental design configuration.

The lid 76, handle bracket 84, detachable handle 100, retaining clip 102 and docking station 116 are all formed of a thermoplastic material preferably selected from a group consisting of polycarbonate, polyethylene, polyimide, polystyrene, polypropylene, polysulfone, polyurethane, and ethylene-vinyl-acetate and has an outside finish that is textured in one manner or the other.

It should be noted that main novelty of the invention is to individually select a combination of these accessories to personalize the appearance and tactile qualities of the coffee mug.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

What is claimed is:

1. A coffee mug with interchangeable accessories comprising:

a coffee mug body having an open top, bottom, and sides with a circumferential groove around an upper outside surface of the sides and a base attached to the bottom, with said base further having integral female threads on its underside, at least two removable lids for disposition onto the mug body open top, wherein said lids are structurally different from each other, at least two replaceable handle brackets, each bracket configured to interface with the groove in the mug body sides, and attachable therein, wherein said brackets are structurally different from each other, at least two detachable handles, each handle having a retaining clip for connection to a respective one of said handle brackets, wherein said handles are structurally different from each other, at least two removable docking stations configured to be rotatably fastened to the base of the coffee mug body, wherein said docking stations are structurally different from each other; and wherein one each of said lids, brackets, handles, and docking stations is selected to personalize the appearance and tactile qualities of the coffee mug, wherein said selected handle and bracket are configured to mate with each other.

2. The coffee mug as recited in claim 1 wherein said coffee mug body sides further comprises stainless steel dual walls having a void therebetween, for thermal barrier insulation, and said bottom is insulated by the base.

3. The coffee mug as recited in claim 1 wherein one of said removable lids further comprises a sliding cover attached thereunto for protecting liquids contained within the mug.

4. The coffee mug as recited in claim 1 wherein each of said replaceable handle brackets further comprises a round ring structure configured to mate in a inversely proportional manner with the groove in the mug sides.

5. The coffee mug as recited in claim 1 wherein one of said replaceable handle brackets further comprising a oval ring structure having a bead on inside surface, configured to mate in a inversely proportional manner with the groove in the mug sides.

6. The coffee mug as recited in claim 1 wherein one of said replaceable handle brackets further comprises a rectangular structure with radiused edges and a bead on inside and outside surface with the bead on inside surface configured to mate in a inversely proportional manner with the groove in the mug sides.

7. The coffee mug as recited in claim 1 wherein one of said replaceable handle brackets further having radial grooves spaced at a predetermined distance apart around the bracket circumference with an o-ring disposed within each groove for maintaining a close and tight fit between the bracket and the mug body.

8. The coffee mug as recited in claim 1 wherein each of said replaceable handle brackets further comprises a pair of parallel protruding ends, with each end having a notch therein for interfacing with the handle and retaining clip.

9. The coffee mug as recited in claim 8 wherein each of said detachable handles further having at least one cavity for receiving and positioning said retaining clip.

10. The coffee mug as recited in claim 9 wherein said retaining clip further comprises a pair of snap-in barbs to interface with the cavity within the detachable handle.

11. The coffee mug as recited in claim 1 wherein each of said docking stations further comprising, a main docking station member having a top and a bottom, with said bottom larger in surface area than the coffee mug base, said main docking station member having a recess formed within the top, including an elevated peripheral lip sized to fit over and enclose the coffee mug base, a raised pedestal within the recess of the main docking main station member, and a plurality of partial male threads depending outwardly from the body raised pedestal, such that when the main docking station member is mated with the coffee mug base and rotated, the male threads interface with the base's female threads bringing the pedestal into intimate contact with the base, thus fastening the main docking station member to the base of the coffee mug in a removable manner.

12. The coffee mug as recited in claim 1 wherein one of said removable docking stations further comprising an ornamental design configuration.

13. The coffee mug as recited in claim 1 wherein each of said lids, handle brackets, detachable handles, retaining clip and docking stations are formed of a thermoplastic material selected from a group consisting of polycarbonate, polyethylene, polyimide, polystyrene, polypropylene, polysulfone, polyurethane, and ethylene-vinyl-acetate.

* * * * *